US007850524B2

(12) United States Patent
Jackson

(10) Patent No.: US 7,850,524 B2
(45) Date of Patent: Dec. 14, 2010

(54) PROGRESSIVE JACKPOT GAME WITH SPECIAL BONUS

(75) Inventor: Kathleen Nylund Jackson, Scituate, MA (US)

(73) Assignee: WMS Gaming Inc., Waukegan, IL (US)

( * ) Notice: Subject to any disclaimer, the term of this patent is extended or adjusted under 35 U.S.C. 154(b) by 534 days.

(21) Appl. No.: 10/804,585

(22) Filed: Mar. 18, 2004

(65) Prior Publication Data

US 2004/0242320 A1 Dec. 2, 2004

Related U.S. Application Data

(60) Provisional application No. 60/457,813, filed on Mar. 25, 2003.

(51) Int. Cl.
*A63F 9/24* (2006.01)

(52) U.S. Cl. ..... 463/27; 463/12; 463/13; 463/16; 463/20; 463/25; 463/26; 463/28

(58) Field of Classification Search ..... 463/12, 463/13, 16, 20, 25–28
See application file for complete search history.

(56) References Cited

U.S. PATENT DOCUMENTS

| | | | | |
|---|---|---|---|---|
| 4,624,459 A | | 11/1986 | Kaufman | 273/143 R |
| 4,837,728 A | * | 6/1989 | Barrie et al. | 463/27 |
| 4,861,041 A | * | 8/1989 | Jones et al. | 273/292 |
| 4,948,134 A | | 8/1990 | Suttle et al. | 273/85 |
| 5,116,055 A | | 5/1992 | Tracy | 273/138 A |
| 5,249,800 A | | 10/1993 | Hilgendorf et al. | 273/138 A |
| 5,275,400 A | | 1/1994 | Weingardt et al. | 463/12 |
| 5,280,909 A | | 1/1994 | Tracy | 273/138 A |
| 5,344,144 A | | 9/1994 | Canon | 273/138 A |
| 5,377,973 A | | 1/1995 | Jones et al. | 273/85 CP |
| 5,393,057 A | | 2/1995 | Marnell, II | 273/85 CP |
| 5,417,430 A | | 5/1995 | Breeding | 273/292 |

(Continued)

FOREIGN PATENT DOCUMENTS

| | | |
|---|---|---|
| CA | 2 334 546 | 8/2001 |

(Continued)

OTHER PUBLICATIONS

Article for "Easy Riches" by Sigma Game, Strictly Slots, 1 page (Aug. 2001).

(Continued)

*Primary Examiner*—Xuan M Thai
*Assistant Examiner*—Kang Hu
(74) *Attorney, Agent, or Firm*—Nixon Peabody LLP

(57) ABSTRACT

A method of providing all players on a linked network to receive a bonus opportunity based on one player hitting the primary jackpot. All players in an active game, (i.e., the reel spinning mode has been activated by the player bet, and the reels have not yet stopped) receive a bonus opportunity when the primary jackpot is hit. Examples of bonuses are of "scratch tickets" to players that would distribute varying amounts, or a secondary jackpot bonus of a fixed amount or an amount in proportion to the main jackpot. An alternative bonus incorporates a specific time span after the primary jackpot is hit where all players have the chance for a bonus payoff or prize, without having to achieve the extremely high rank of the jackpot award.

22 Claims, 14 Drawing Sheets

U.S. PATENT DOCUMENTS

| | | | | | |
|---|---|---|---|---|---|
| 5,524,888 | A | | 6/1996 | Heidel | 463/22 |
| 5,544,892 | A | | 8/1996 | Breeding | 273/292 |
| 5,564,700 | A | * | 10/1996 | Celona | 463/27 |
| 5,577,959 | A | | 11/1996 | Takemoto | 463/25 |
| 5,580,063 | A | | 12/1996 | Edwards | 273/378 |
| 5,580,309 | A | | 12/1996 | Piechowiak et al. | 463/16 |
| 5,611,730 | A | | 3/1997 | Weiss | 463/20 |
| 5,645,486 | A | | 7/1997 | Nagao et al. | 463/27 |
| 5,647,592 | A | | 7/1997 | Gerow | 463/139 |
| 5,655,961 | A | * | 8/1997 | Acres et al. | 463/27 |
| 5,766,076 | A | | 6/1998 | Pease et al. | 463/27 |
| RE35,864 | E | | 7/1998 | Weingardt | 463/28 |
| 5,779,549 | A | | 7/1998 | Walker et al. | 463/42 |
| 5,816,918 | A | | 10/1998 | Kelly et al. | 463/16 |
| 5,820,459 | A | | 10/1998 | Acres et al. | 463/25 |
| 5,823,874 | A | | 10/1998 | Adams | 463/17 |
| 5,830,063 | A | * | 11/1998 | Byrne | 463/18 |
| 5,839,956 | A | | 11/1998 | Takemoto | 463/25 |
| 5,848,932 | A | | 12/1998 | Adams | 463/20 |
| 5,851,147 | A | | 12/1998 | Stupak | 463/13 |
| 5,855,515 | A | | 1/1999 | Pease et al. | 463/27 |
| 5,876,284 | A | | 3/1999 | Acres et al. | 463/25 |
| 5,885,158 | A | | 3/1999 | Torango et al. | 463/27 |
| 5,941,773 | A | | 8/1999 | Harlick | 463/26 |
| 5,944,606 | A | | 8/1999 | Gerow | 463/27 |
| 5,951,011 | A | | 9/1999 | Potter et al. | 273/292 |
| 6,003,013 | A | | 12/1999 | Boushy et al. | 705/10 |
| 6,007,427 | A | | 12/1999 | Wiener et al. | 463/17 |
| 6,012,982 | A | | 1/2000 | Piechowiak et al. | 463/16 |
| 6,032,955 | A | | 3/2000 | Luciano et al. | 273/138.1 |
| 6,047,963 | A | | 4/2000 | Pierce et al. | 273/121 B |
| 6,089,977 | A | | 7/2000 | Bennett | 463/20 |
| 6,089,980 | A | * | 7/2000 | Gauselmann | 463/27 |
| 6,102,474 | A | | 8/2000 | Daley | 296/836 |
| 6,102,799 | A | | 8/2000 | Stupak | 463/27 |
| 6,110,043 | A | | 8/2000 | Olsen | 463/27 |
| 6,139,013 | A | | 10/2000 | Pierce et al. | 273/121 B |
| 6,142,872 | A | | 11/2000 | Walker et al. | 463/16 |
| 6,146,273 | A | * | 11/2000 | Olsen | 463/27 |
| 6,155,925 | A | | 12/2000 | Giobbi et al. | 463/20 |
| 6,158,741 | A | | 12/2000 | Koelling | 273/292 |
| 6,159,097 | A | | 12/2000 | Gura | 463/20 |
| 6,168,523 | B1 | | 1/2001 | Piechowiak et al. | 463/26 |
| 6,203,010 | B1 | | 3/2001 | Jorasch et al. | 273/138.1 |
| 6,206,374 | B1 | | 3/2001 | Jones | 273/292 |
| 6,206,782 | B1 | | 3/2001 | Walker et al. | 463/25 |
| 6,210,275 | B1 | | 4/2001 | Olsen | 463/16 |
| 6,210,277 | B1 | | 4/2001 | Stefan | 463/27 |
| 6,217,448 | B1 | | 4/2001 | Olsen | 463/25 |
| 6,220,593 | B1 | | 4/2001 | Pierce et al. | 273/138.1 |
| 6,224,482 | B1 | | 5/2001 | Bennett | 463/20 |
| 6,224,484 | B1 | | 5/2001 | Okuda et al. | 463/27 |
| 6,231,445 | B1 | | 5/2001 | Acres | 463/42 |
| 6,241,608 | B1 | | 6/2001 | Torango | 463/27 |
| 6,254,483 | B1 | * | 7/2001 | Acres | 463/26 |
| 6,312,332 | B1 | | 11/2001 | Walker et al. | 463/23 |
| 6,315,660 | B1 | | 11/2001 | DeMar et al. | 463/16 |
| 6,319,125 | B1 | * | 11/2001 | Acres | 463/25 |
| 6,319,127 | B1 | | 11/2001 | Walker et al. | 463/26 |
| 6,336,859 | B2 | | 1/2002 | Jones et al. | 463/13 |
| 6,336,862 | B1 | | 1/2002 | Byrne | 463/27 |
| 6,345,824 | B1 | | 2/2002 | Selitzky | 273/292 |
| 6,358,149 | B1 | | 3/2002 | Schneider et al. | 463/27 |
| 6,361,441 | B1 | | 3/2002 | Walker et al. | 463/42 |
| 6,364,768 | B1 | | 4/2002 | Acres et al. | 463/25 |
| 6,375,567 | B1 | | 4/2002 | Acres | 463/25 |
| 6,375,568 | B1 | | 4/2002 | Roffman et al. | 463/26 |
| 6,416,409 | B1 | | 7/2002 | Jordan | 463/27 |
| 6,431,983 | B2 | | 8/2002 | Acres | 463/25 |
| 6,435,968 | B1 | | 8/2002 | Torango | 463/27 |
| 6,439,995 | B1 | | 8/2002 | Hughs-Baird et al. | 463/20 |
| 6,482,089 | B2 | | 11/2002 | DeMar et al. | 463/20 |
| 6,506,117 | B2 | | 1/2003 | DeMar et al. | 463/20 |
| 6,508,707 | B2 | | 1/2003 | DeMar et al. | 463/16 |
| 6,517,433 | B2 | | 2/2003 | Loose et al. | 463/20 |
| 6,520,855 | B2 | | 2/2003 | DeMar et al. | 463/20 |
| 6,577,733 | B1 | | 6/2003 | Charrin | 380/251 |
| 6,589,115 | B2 | | 7/2003 | Walker et al. | 463/25 |
| 6,592,458 | B1 | | 7/2003 | Ho | 463/17 |
| 6,592,460 | B2 | | 7/2003 | Torango | 463/27 |
| 6,599,186 | B1 | | 7/2003 | Walker et al. | 463/17 |
| 6,599,188 | B2 | | 7/2003 | Hirsch et al. | 463/19 |
| 6,599,193 | B2 | | 7/2003 | Baerlocher et al. | 463/27 |
| 6,601,771 | B2 | | 8/2003 | Charrin | 235/492 |
| 6,648,762 | B2 | | 11/2003 | Walker et al. | 463/25 |
| 6,656,052 | B2 | | 12/2003 | Abramopoulos et al. | 463/47 |
| 6,676,513 | B2 | | 1/2004 | Gauselmann | 463/20 |
| 6,712,695 | B2 | | 3/2004 | Mothwurf et al. | 463/25 |
| 6,733,390 | B2 | | 5/2004 | Walker et al. | 463/23 |
| 6,875,108 | B1 | * | 4/2005 | Hughs-Baird | 463/26 |
| 7,004,466 | B2 | | 2/2006 | Gauselmann | 463/138 |
| 7,036,012 | B2 | | 4/2006 | Charrin | 713/169 |
| 7,056,215 | B1 | | 6/2006 | Olive | 463/27 |
| 7,255,645 | B2 | * | 8/2007 | Steil et al. | 463/27 |
| 7,562,873 | B1 | * | 7/2009 | Luciano, Jr. | 273/139 |
| 2002/0138594 | A1 | | 9/2002 | Rowe | 709/219 |
| 2002/0151345 | A1 | | 10/2002 | Byrne | 463/18 |
| 2002/0155874 | A1 | | 10/2002 | Byrne | 463/16 |
| 2003/0014370 | A1 | | 1/2003 | Charrin | 705/65 |
| 2003/0027618 | A1 | | 2/2003 | Byrne | 463/16 |
| 2003/0027625 | A1 | | 2/2003 | Rowe | 463/20 |
| 2003/0036430 | A1 | | 2/2003 | Cannon | 463/42 |
| 2003/0045337 | A1 | | 3/2003 | Byrne | 463/16 |
| 2003/0050106 | A1 | | 3/2003 | Lyfoung | 463/13 |
| 2003/0060266 | A1 | | 3/2003 | Baerlocher | 463/20 |
| 2003/0064776 | A1 | | 4/2003 | Byrne | 463/16 |
| 2003/0109306 | A1 | | 6/2003 | Karmarkar | 463/40 |
| 2003/0148808 | A1 | | 8/2003 | Price | 463/27 |
| 2003/0181231 | A1 | | 9/2003 | Vancura et al. | 463/9 |
| 2003/0186733 | A1 | | 10/2003 | Wolf et al. | 463/16 |
| 2003/0211884 | A1 | | 11/2003 | Gauselmann | 463/20 |
| 2003/0216166 | A1 | | 11/2003 | Baerlocher et al. | 463/20 |
| 2003/0222402 | A1 | | 12/2003 | Olive | 273/292 |
| 2003/0228899 | A1 | | 12/2003 | Evans | 463/25 |
| 2003/0236116 | A1 | | 12/2003 | Marks et al. | 463/16 |
| 2004/0009808 | A1 | | 1/2004 | Gauselmann | 463/25 |
| 2004/0009811 | A1 | | 1/2004 | Torango | 463/25 |
| 2004/0023716 | A1 | | 2/2004 | Gauselmann | 463/23 |
| 2004/0038741 | A1 | | 2/2004 | Gauselmann | 463/42 |
| 2004/0048644 | A1 | | 3/2004 | Gerrard et al. | 463/16 |
| 2004/0092304 | A1 | | 5/2004 | George | 463/29 |
| 2005/0003880 | A1 | | 1/2005 | Engleman | 463/16 |
| 2005/0055113 | A1 | | 3/2005 | Gauselmann | 700/91 |
| 2005/0059467 | A1 | | 3/2005 | Saffari et al. | 463/19 |
| 2005/0059472 | A1 | | 3/2005 | Joshi et al. | 463/20 |
| 2005/0064930 | A1 | | 3/2005 | Jubinville et al. | 463/17 |
| 2005/0096130 | A1 | | 5/2005 | Mullins | 463/27 |
| 2005/0137010 | A1 | | 6/2005 | Enzminger et al. | 463/25 |
| 2005/0192088 | A1 | | 9/2005 | Hartman et al. | 463/27 |
| 2005/0215313 | A1 | | 9/2005 | O'Halloran | 463/26 |
| 2006/0003829 | A1 | | 1/2006 | Thomas | 463/20 |
| 2006/0019737 | A1 | | 1/2006 | Yang | 463/19 |
| 2006/0025195 | A1 | | 2/2006 | Pennington et al. | 463/16 |
| 2006/0025210 | A1 | | 2/2006 | Johnson | 463/25 |
| 2006/0030403 | A1 | | 2/2006 | Lafky et al. | 463/27 |
| 2006/0052159 | A1 | | 3/2006 | Cahill et al. | 463/27 |
| 2006/0073877 | A1 | | 4/2006 | Rodgers et al. | 463/20 |
| 2006/0073889 | A1 | | 4/2006 | Edidin et al. | 463/27 |
| 2006/0116201 | A1 | | 6/2006 | Gausselmann | 463/26 |
| 2006/0142079 | A1 | | 6/2006 | Ikehara et al. | 463/27 |
| 2006/0142086 | A1 | | 6/2006 | Blackburn et al. | 463/42 |
| 2006/0154718 | A1 | | 7/2006 | Willyard et al. | 463/25 |
| 2006/0178203 | A1 | | 8/2006 | Hughes et al. | 463/20 |
| 2006/0183535 | A1 | | 8/2006 | Marks et al. | 463/20 |

| | | | | |
|---|---|---|---|---|
| 2006/0183537 | A1 | 8/2006 | Dickerson | 463/27 |
| 2006/0183538 | A1 | 8/2006 | Michaelson et al. | 463/27 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2313792 | A | 10/1997 |
| GB | 2 333 880 | | 8/1999 |
| WO | WO 99 03078 | A1 | 1/1999 |
| WO | WO 99/19037 | A1 | 4/1999 |
| WO | WO 01/33478 | A1 | 5/2001 |
| WO | WO/03/026754 | A1 | 4/2003 |
| WO | WO/03/083789 | A1 | 10/2003 |

OTHER PUBLICATIONS

Article for "Millioniser" by Glenn Haussman, Strictly Slots, pp. 50-53 (Mar. 2004).
Product Sheet for "Big Games Safari," IGT, 24 pages (2000).
"New '97 Games," International Gaming & Wagering Business, 24 pages (Mar. 1997).
International Search Report—PCT/US06/20979 dated Nov. 13, 2006 (2 pages).

* cited by examiner

PROGRESSIVE JACKPOT GAME WITH SPECIAL BONUS

RELATED U.S. APPLICATION DATA

This Application claims priority from U.S. Provisional Application Ser. No. 60/457,813 filed on Mar. 25, 2003.

BACKGROUND OF THE INVENTION

1. Field of the Invention

The present invention relates to gaming play, jackpot or bonus systems in gaming play, and bonus play in gaming that distributes money among a plurality players playing gaming systems when a jackpot is achieved by one player.

2. Background of the Art

Gaming play is usually considered in two distinct formats, table gaming and slot gaming. Table gaming is the form of wagering where one or more players is present at a table and the house (casino) manages the play of the game, taking and paying off wagers on events that are supervised by the house. Traditional table games include, for example, roulette, craps, blackjack, poker games, poker-like games, Casino War, Candy wheel games, baccarat, Acey-Deucey, matching symbol (or card) games, and the like. Conventional Keno would be considered a table game, even though players are not required to sit at single table. Poker and poker-like games include all of the many variants, including at least Let It Ride® poker, Three Card® poker, High Five® poker, Caribbean Stud® poker, 4-Card stud poker, wild card poker games, and the like.

Slot gaming is a term that derived from the fact that the original games required that coins be wagered in an apparatus by placing coins into a slot. Today, coins, currency, cash cards, credit cards, house cards, account cards, or any other system that can track moneys wagered at a machine and assure collection by the casino are useful wagering formats in slot machine. The slot machine is any apparatus (mechanical, electrical, or electromechanical) in which a player wagers amounts of value (money or credits or debt) in the play of a game that is performed on or displayed by the machine. Originally, slot machines were mechanical devices with spinning wheels or reels, or mechanically arranged cards or panels. A wager was made and the machine was caused (e.g., by pulling a lever) to randomly display images or symbols in a display area. Wagers were won by symbols that were predetermined to be winners. One of the earlier forms of predetermined winning collections of symbols was poker hands. When poker hands of at least minimum ranks were displayed, the device or an attendant would award the player for the value of the hand. Reel-type slot machines display artificial symbols (e.g., cherries, bells, lemons, oranges, 7's, plums, bars, double bars, triple bars, special symbols, etc.) and provide a pay table that identifies winning hands which are paid by the house. Slot machines have progressed from purely mechanical system where power is provided by the players' arms, to electromechanical systems, to purely electronic systems with games actually played by a local or distal processor (computer) and the results displayed on a display system (e.g., CRT, plasma display, liquid crystal display, LED display, etc.). The use of electronic games has greatly increased the flexibility and variety of games that can be played on slot machines.

In both table games and slot machines, the use of jackpots and especially progressive jackpots has been very successful in the gaming industry, attracting many players to the potential for large jackpot payouts. Progressive jackpots have been particularly successful as the jackpot increases over time, reaching dramatic amounts of tens of millions of dollars in some cases. Large jackpot casino table games include Let It Ride® poker and Caribbean Stud® poker. Many slot machines and video gaming systems have progressive jackpots that are either locally connected in banks of machines or more widely based networks among different casinos in the same jurisdiction or region. Networked systems have produced many high value progressive bonus awards, as best exemplified by the Megabucks® slot game. By having games networked, many players are contributing a portion of their wagers to the jackpot, and the many contributions by players increase the jackpot rapidly.

One of the deficiencies of progressive jackpots is that the normal payout to the player must be smaller to both build up the jackpot and provide the house with its required profit margin on wagers. This tends to slant play of progressive games to more heavy play as the progressive jackpot grows, while play diminishes as soon as a jackpot is awarded. This has led to attempts to either moderate the growth of the jackpot to assure higher payout frequencies and lower house retention during normal play. This has been merely a balancing act that has not improved the play or attractiveness of the progressive games.

U.S. Pat. No. 5,580,063 describes a gambling game in which a collateral gambling game is played that can be won by players on at least one specific event occurring in the principal game. The collateral game is separate from the principal game, but one when any of the possible winning events occur in the principal game, the payment to the player is calculated from the total value available for the game divided by the total number of players who bet on the specific winning event. The game gives a possibility for a large number of players to share in the success of a single player who has successfully won the main game. It may be used with various types of games including those using electronic gaming machines.

U.S. Pat. No. 6,224,482 describes a random prize awarding system associated with a gaming console is provided in which the gaming console is arranged to play a first game or a second game, the first game being a standard game normally offered on the console and the second game being a jackpot game offered for play when the player has achieved a trigger condition where the trigger means is arranged to test for the trigger condition and to initiate an instance of the second game when the trigger condition occurs. The second game is divided into a plurality of sub-games, each having an incremental prize such that a sum of the un-won incremental prizes equals the total currently available jackpot prize value of the second game. The player is awarded each sub-game after the first, only if the incremental prize was won in the previous sub-game. The jackpot prize value being decremented by the incremental prize value awarded with the occurrence of each winning sub-game. The additional bonus is potentially awarded only to the player that has won the jackpot.

U.S. Pat. No. 6,375,568 describes an interactive gaming process and system. The system comprises a plurality of gaming machines to be played by plurality of players. The system can be configured such that the gaming machines are either located in a casino or at internet locations. Each gaming machine comprises a wagering game and a theme game, respectively. The wagering game has features that correspond to the theme game wherein the results of the wagering game influence the results of the theme game as the wagering game is being played. The system also includes a controller for electronically linking the gaming machines and providing stimuli to the gaming machines so as to effect gaming machine outputs that are impartial and random. In one embodiment, the plurality of players play the wagering game as a group wherein if one player's theme game results meet predetermined criteria, that particular player will play for the group. The group will then have the opportunity to split a jackpot. In another embodiment, the plurality of players play as a group wherein activation of each player's wagering game either helps or hinders the group as a whole in its effort to achieve a predetermined goal. In a further embodiment, the players play their respective wagering game so as to directly compete against each other in the theme game. The results of the wagering games determine the winnings of each player, the eventual winner of the theme game and/or any predetermined jackpot.

U.S. Pat. No. 6,089,980 describes a method of a shared jackpot system of a gambling apparatus unit is provided, where the gambling apparatus unit comprises a plurality of coin-operated gambling machines. The gambling machines are linked to each other and jointly fill a jackpot. A predetermined part of the gambling bet of each gambling machine is employed to fill the jackpot. The filling level of the jackpot is displayed on each gambling machine and with a large display. A communication board is coordinated to each gambling apparatus in addition to a control unit. Upon actuation of the gambling machines, it is automatically determined which one of the gambling machines assumes the control in the form of a master. The master gambling machine monitors whether a jackpot trigger value is present. In case a jackpot trigger value is present, a command sequence is sent to all linked gambling machines. At the same time there occurs a final game in the gambling machines based on the command sequence. A rank sequence and a winning quota, respectively, is determined based on the predicted game result and the actual game result, wherein the rank sequence and the winning quota, respectively, represents a distribution key for the jackpot.

U.S. Pat. No. 6,336,862 describes a method for distributing a progressive jackpot among players at progressive linked gaming machines comprising: providing a plurality of gaming machines, each of said gaming machines being capable of a) accepting a bet of an amount of money from a player, b) after accepting said bet, performing a play cycle initiated by said player, and c) generating an outcome of said play cycle, said outcome being one of a plurality of possible outcomes, at least one of said outcomes being a progressive jackpot-winning outcome; collecting betting data from said gaming machines, said betting data representing said amounts of money bet by players at each of said machines; determining from said betting data the value of a progressive jackpot; detecting the occurrence of said progressive jackpot-winning outcome at one of said gaming machines; and, upon the occurrence of said progressive jackpot-winning outcome, distributing at least a portion of said progressive jackpot among a plurality of eligible players, all of whom will receive a portion of said jackpot, selected from among said players playing at said plurality of gaming machines, said eligible players being selected independently of any of said outcomes at said plurality of said gaming machines. A plurality of progressive jackpots are accumulated and distributed upon the occurrence of a progressive jackpot-winning outcome.

U.S. Pat. No. 6,168,523 describes a system of linked gaming machines has each of the linked gaming machines connected to a common controller. In a normal mode of play, each of the linked gaming machines operates like a conventional machine where the generation of certain combinations of symbols provides awards to the individual players whose machines generate such combinations. In addition to this normal mode of play, a bonus feature is added where the generation of combinations of bonus symbols is used by a central controller to build up a pooled bonus value based upon the values of the combinations of bonus symbols generated by all the linked gaming machines. When a player hits a combination which causes the accumulated bonus value to meet or exceed a predetermined value, a bonus award is given to the player which caused the threshold to be exceeded.

U.S. Published Patent Application Ser. No. 20030045337 describes a gambling game having a collateral gambling game which can be won by players on at least one specific event occurring in the principal game, the collateral game being separate from the principal game but one when any of the possible winning events occur in the principal game, the payment to the player being calculated from the total value available for the game divided by the total number of players who bet on the specific winning event. The game gives a possibility for a large number of players to share in the success of a single player who has successfully won the main game. It may be used with various types of games including those using electronic gaming machines.

Other disclosures of play and events in bonusing and jackpots include U.S. Pat. Nos. 6,435,968 (progressive wagering system); 6,431,983 (incentive to play networked games); 6,416,409 (progressive bonus); 6,364,768 (networked devices w/bonus); 6,358,149 (bonus promotions in systems); 6,231,445 (bonus awards on networks); 6,217,448 (Linked machine bonus system); 6,210,277 (game of chance); 6,102,474 or 6,102,799 (super jackpot bonus funding); 6,012,982 (bonus awards on networks); 5,885,158 (progressive system); 5,766,076 (progressive betting system); 5,580,309 (linked gaming machines); 5,564,700 (progressive payout method); and 5,280,909 (progressive jackpot). Other disclosures include Published U.S. patent applications 20030148808 (personal wide area progressive); 20030064776 (shared success); 20030036430 (competitive linked play); 20030027618 (shared success); 20020155874 (shared success); 20020151345 (shared success); 20020138594 (wide area program); and 20010036857 (jackpot system).

Published U.S. patent application 2003/0186733 A1 describes a gaming apparatus that may include a display unit capable of generating video images, a value input device, and a controller operatively coupled to the display unit and the value input device. The controller may include a processor and a memory operatively coupled to the processor, and may be programmed to allow a person to make a wager. The controller may also be programmed to cause a video image to be generated on the display unit. The video image may represent a game, such as video poker, video blackjack, video slots, video keno or video bingo. The controller may be programmed to determine a value payout associated with an outcome of the game, to compare the value payout to a threshold amount, and to generate a distributed jackpot payout message if the value payout is greater than or equal to the threshold amount.

In spite of these many variations on jackpots and progressive jackpots, additional improvements are desired.

SUMMARY OF THE INVENTION

A jackpot game is played by a plurality of players at the same time. Preferably the game is a progressive jackpot game played at a table, networked tables, slot machine bank or slot machine network. Players in the game at the time that a jackpot is won are given the opportunity to win a special bonus or mini-jackpot. The award of the special bonus or mini-jackpot is preferably randomly determined (either by continued play of the game or by random selection from the central processor). Certain safeguards can be applied to the system of play to make certain that there is sufficient impact from the potential award of the bonus or mini-jackpot, as by requiring that a minimum number of players be on-line on the system or in the game at the time that the special bonus or mini-jackpot is being awarded.

DETAILED DESCRIPTION OF THE INVENTION

Figure 1:
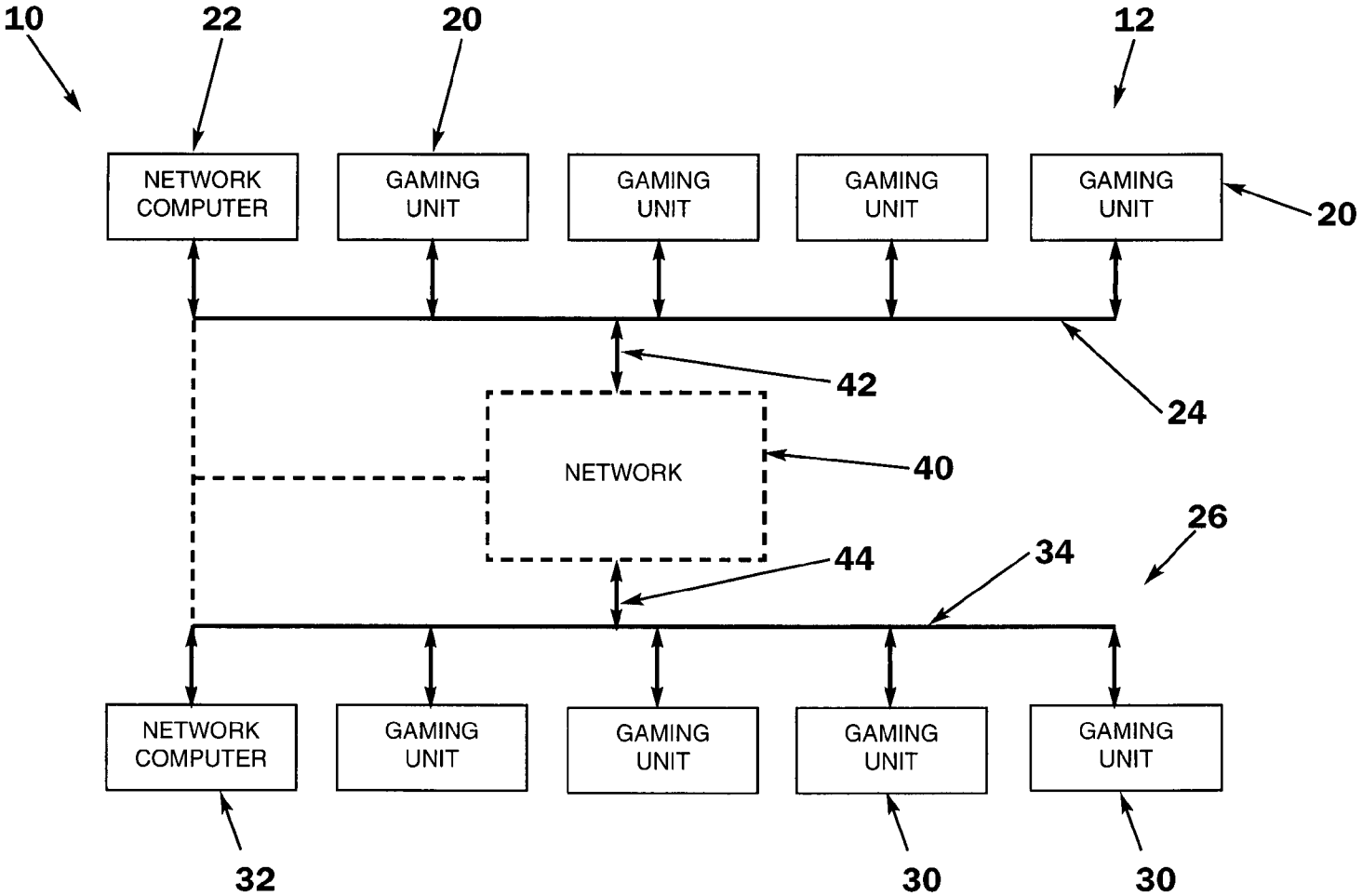
FIG. 1 is a block diagram of an embodiment of a gaming system.

An underlying game is played that provides a jackpot or progressive jackpot. The basic play of the underlying game is preferably unaltered. When one player wins the jackpot or bonus jackpot, it is preferred that the winning player is excluded from the special bonus play or mini-jackpot play event that then occurs. A special bonus event or mini jackpot event is then entered. With a networked slot gaming system, there are many alternative bonus systems that can be provided. These special bonus systems may include at least one or more of the following components:

I. Immediate Random Bonus

Upon one player in a networked gaming system winning a jackpot, a central computer identifies machines that are in active use and randomly assigns bonuses to less then all of the machines. The bonuses or mini-jackpot(s) may be immediately awarded or awarded over a fixed amount of time or fixed amount of play by the combined network machines. For example, all amounts designated to be provided in the special bonus play may be required by the central computer to be assigned to random machines within a specific period of time (1 minute, five minutes, fifteen minutes, half-an-hour, etc.), or within a specified number of plays of the machines on the network (e.g., within one play, ten plays, one-hundred plays, five-hundred plays, 1,000 plays or the like). The amounts of the payout may be fixed amounts (e.g., $50,000, $25,000, $10,000, $1,000, $500, $100, $25, etc.) an amount equal to a percentage of the jackpot (e.g., 10% or 5% or 1% or) 0.2% of the amount of the jackpot, with the amount taken out of the jackpot pool, or preferably independently of the jackpot pool, even from a separate accumulating mini-pool.

II. Immediate Play Bonus

Upon a player in a networked system winning a jackpot, a central computer identifies machines that are in active use (or in this case all machines may be activated in bonus play) and alters the basic pay table of the underlying game, preferably for a limited amount of time or for that time over which it takes to award a total amount of funds to players on the system. This play will be described for use with networked poker games, only because of the simplicity of working with pay tables for that type of game, but the description is equally applicable to conventional reel-type slot pay tables and keno table or even blackjack games with bonus events (e.g., four straight blackjacks). If the jackpot triggering event is a Royal Flush with cards in descending order from left-to-right, the occurrence of that hand in one machine on the networked system causes the central computer to respond. The computer signals one or more gaming apparatus on the network that a bonus event or mini-jackpot event is occurring. This can be done by alphanumerics or displays on or around the gaming apparatus, sounds, light displays, or combinations thereof. If, for example, the original pay table for the poker game was

| | |
|---|---|
| Royal Flush | Jackpot or 2000X (with less then maximum wager) |
| Straight Flush | 500X |
| Four-of-a-Kind | 250X |
| Full House | 50X |
| Flush | 8X |
| Straight | 7X |
| Three-of-a-Kind | 3X |
| Two Pair | 2X |
| Jacks or Better | 1X |

Upon the achievement of the descending royal flush on one networked machine, the pay table may be changed to show awards of

| | |
|---|---|
| Royal Flush | 2000X (with less then maximum wager) |
| Straight Flush | 1000X |
| Four-of-a-Kind | 500X |
| Full House | 100X |
| Flush | 10X |
| Straight | 9X |
| Three-of-a-Kind | 5X |
| Two Pair | 4X |
| Jacks or Better | 2X |

Other paytable variations may be made so that continued play is promoted for a specific time period or until at least or approximately a predetermined amount of awards are provided during bonus play. For example, the central computer will stop the special bonus after the specified time period or after $50,000 has been awarded during special bonus play (either total or as excess awards, that is for the above Four-of-a-Kind, 500X−250X=250X excess award).

III. Mini-Jackpot Award

After the central computer has been notified that the Jackpot or Progressive Jackpot has been won, preferably with an accompanying signal or alert to every machine already in operation that the mini jackpot even will begin, the central computer will initiate the bonus event. What can be done is that a mini-jackpot amount is identified (e.g., $100,000, $75, 00, $50,000, an amount that is a percentage of the original jackpot amount, preferably without detracting from that jackpot amount) and the highest ranking hand within a specific time period after the mini-jackpot event begins wins the mini-jackpot. Awards may be given for a number of hands (the first three highest hands; the first ten highest hands; or the first 100 highest hands, for example), with ties being given a pro rate share of the mini-jackpot. For example, the mini-jackpot may be $25,000 highest hand, $10,000 second highest hand, $2,000 third highest hand, and $500 for each of the fourth through $100^{th}$ highest hands achieved within one-half hour after the Progressive Jackpot has been won. If the hands achieved during that time period included a) Four Queens, b) two hands of 10's full over a pair of sixes, and hands descending from sevens full, the four Queens would b awarded $25, 000, the 10's full would each get $6,000 ($10,000 plus $2,000 divided by two), and each of the next highest hands would get $500.

IV. Free Play Awards

After the central computer has been notified that the Jackpot or Progressive Jackpot has been won, preferably with an accompanying signal or alert to every machine already in operation that the Free Play award will begin, each machine or selected machines will be awarded negotiable or non-negotiable free play spins on the individual machines. All machines in active play will be awarded the free spins, only random machines may be awarded free spins, and/or different numbers of free spins may be assigned among the various machines. By non-negotiable, it is meant that even though the free spins may be equivalent in effect to actual credit awards, they cannot be cashed in as they could when credits are awarded.

FIG. 1 illustrates an embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44. The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a host computer, a server computer, or one of the gaming units 20, and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
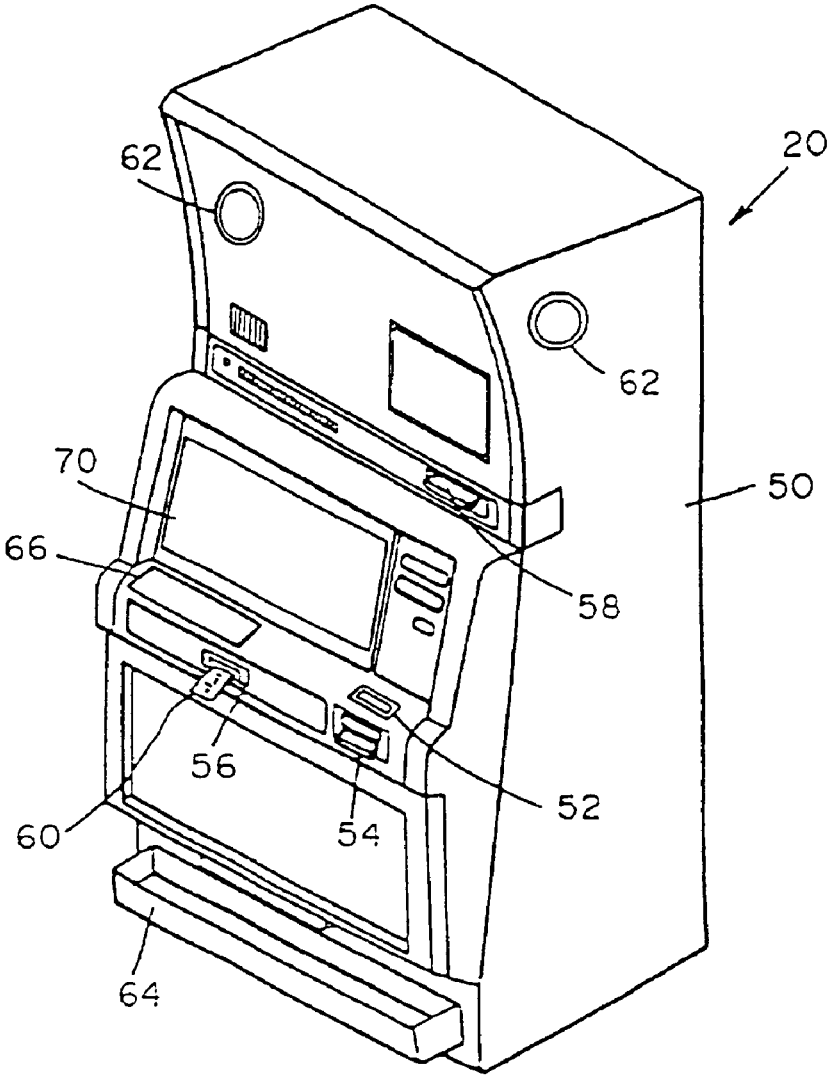
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodeable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. Such images may include distributed jackpot information. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

Figure 2A:
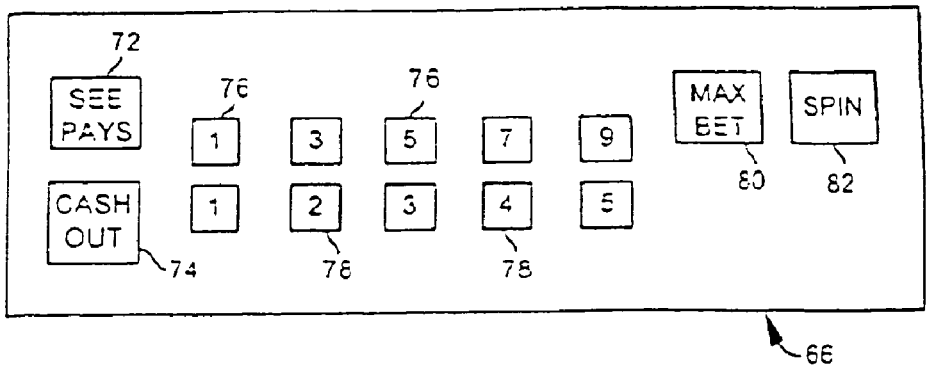
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information (which may include distributed jackpot information) for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Figure 3:
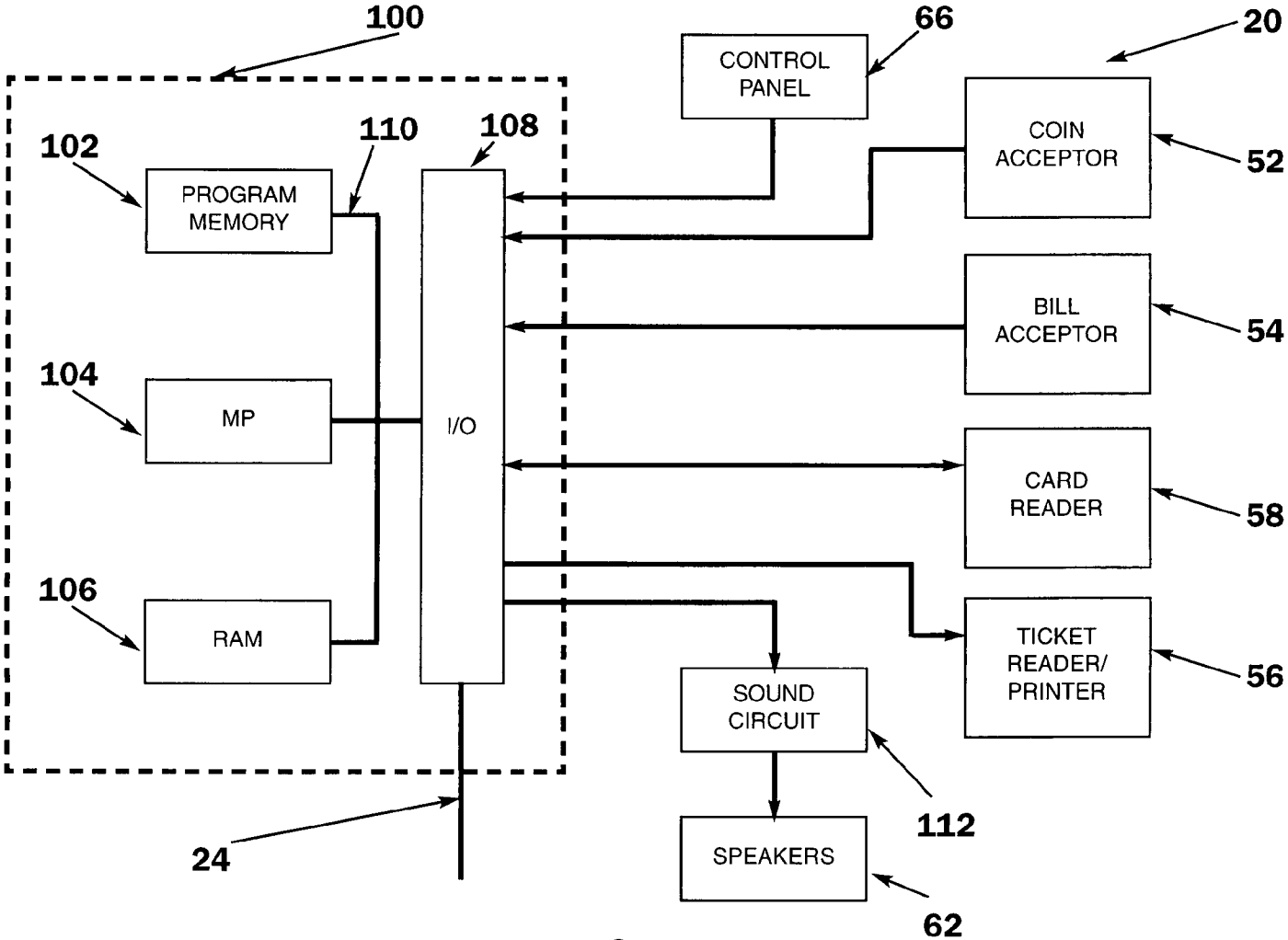
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3, the components 52, 54, 56, 58, 66, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

Figure 4:
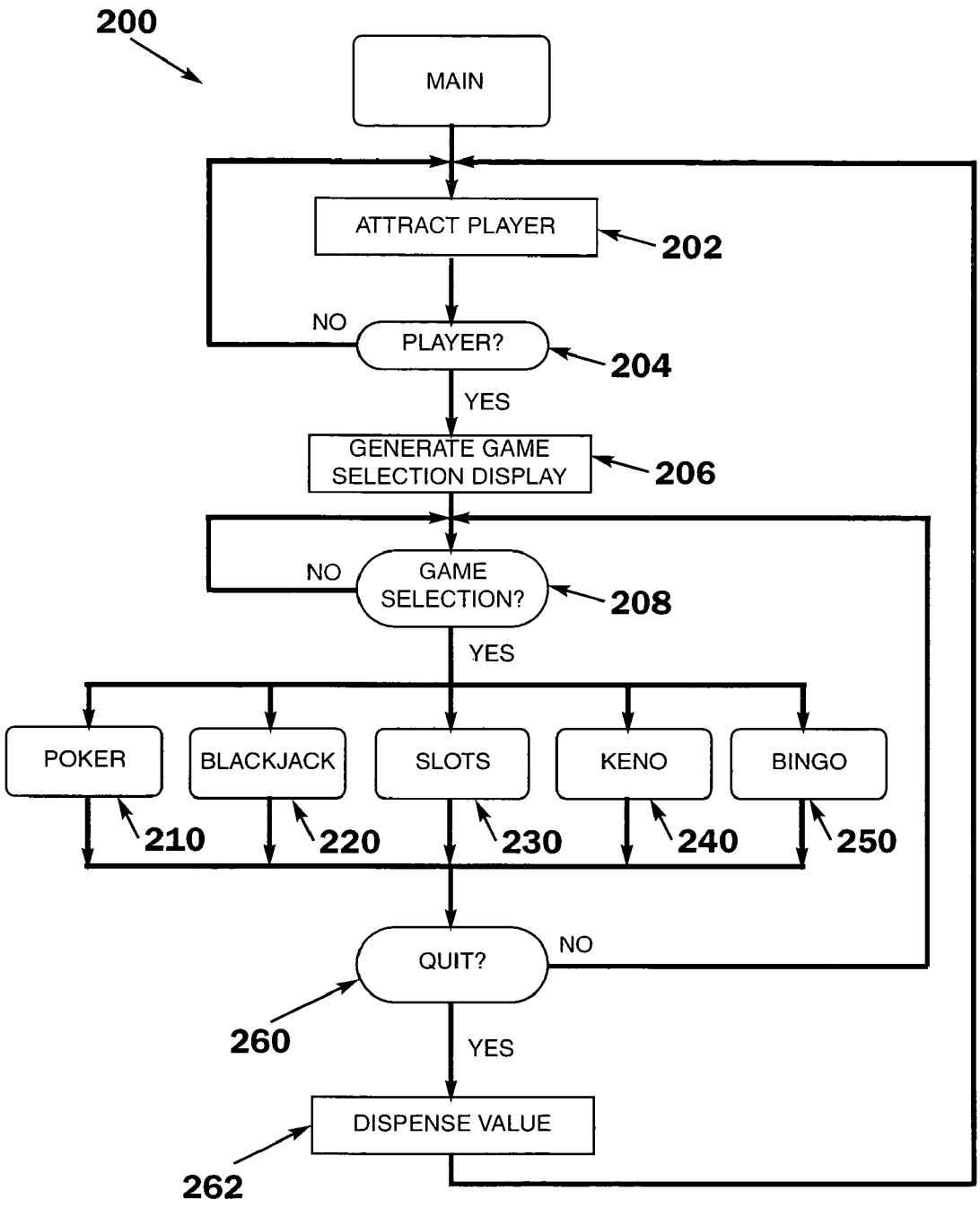
FIG. 4 is a flowchart of an embodiment of a main routine that may be performed during operation of one or more of the gaming units.

FIG. 4 is a flowchart of a main operating routine 200 that may be stored in the memory of the controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit 20; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the game routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games.

Figure 5:
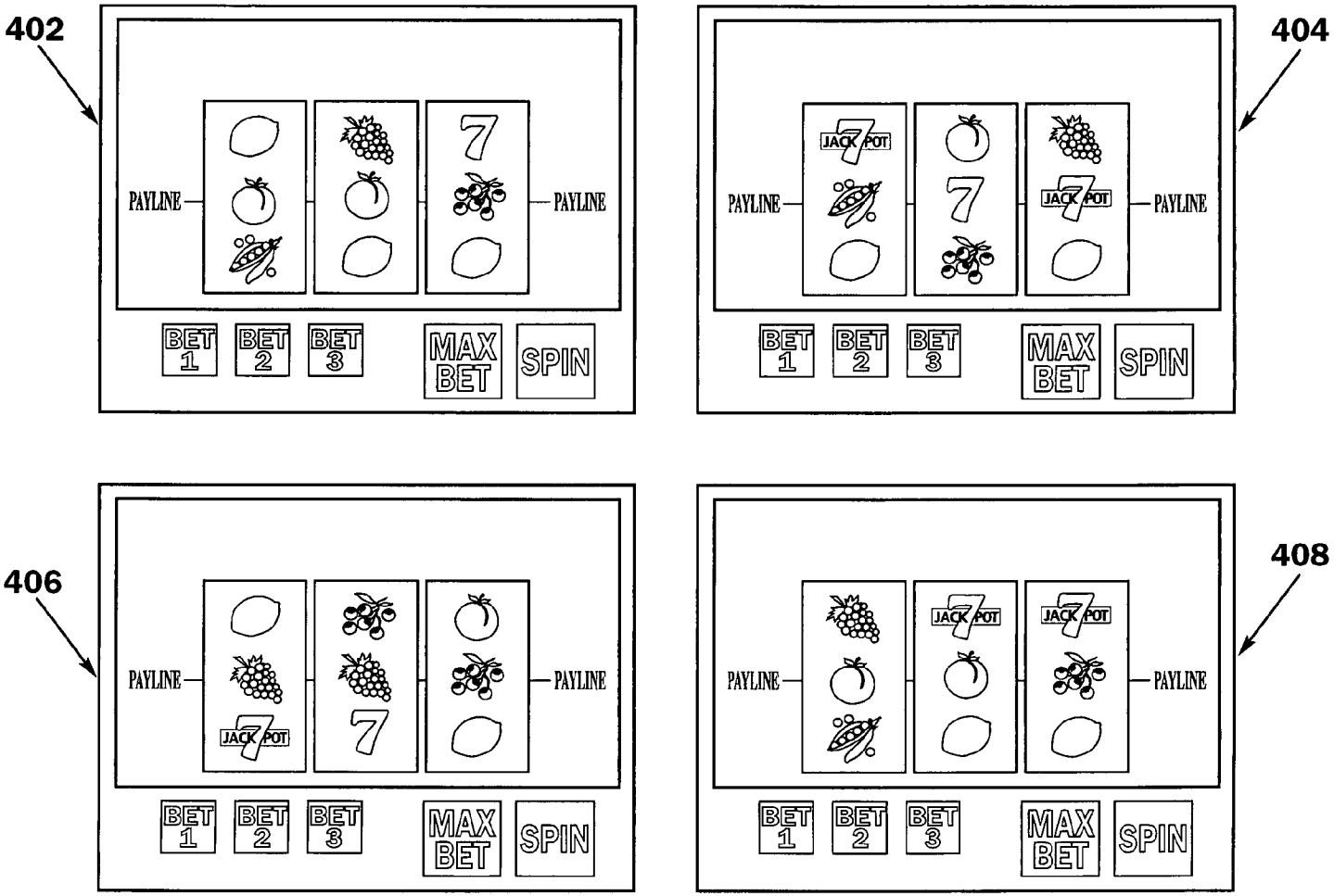
FIG. 5 is an image of four screen shots of four linked gaming machines.

FIG. 5 shows screen shots of four different linked machines 402, 404, 406 and 408.

Figure 6:
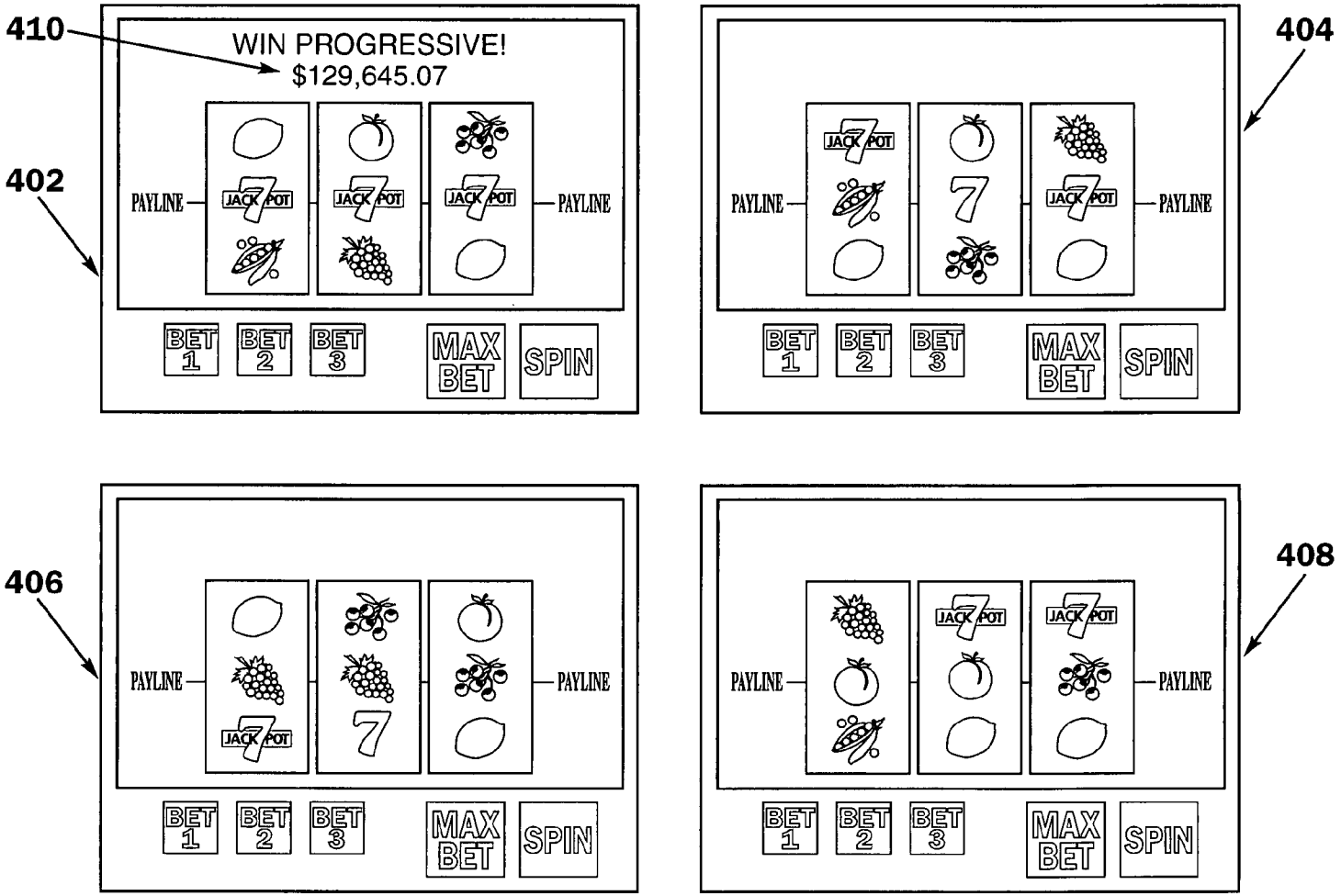
FIG. 6 is an image of four screen shots of four linked gaming machines.

FIG. 6 shows screen shots of four different linked machines 402, 404, 406 and 408 in which the progressive award is noted as announcement 410 on screen 402. A general notice of a jackpot win at another machine (clearly identified so as not to give false indication of the primary jackpot win) may be similarly placed on screen 404, 406 and 408.

Figure 7:
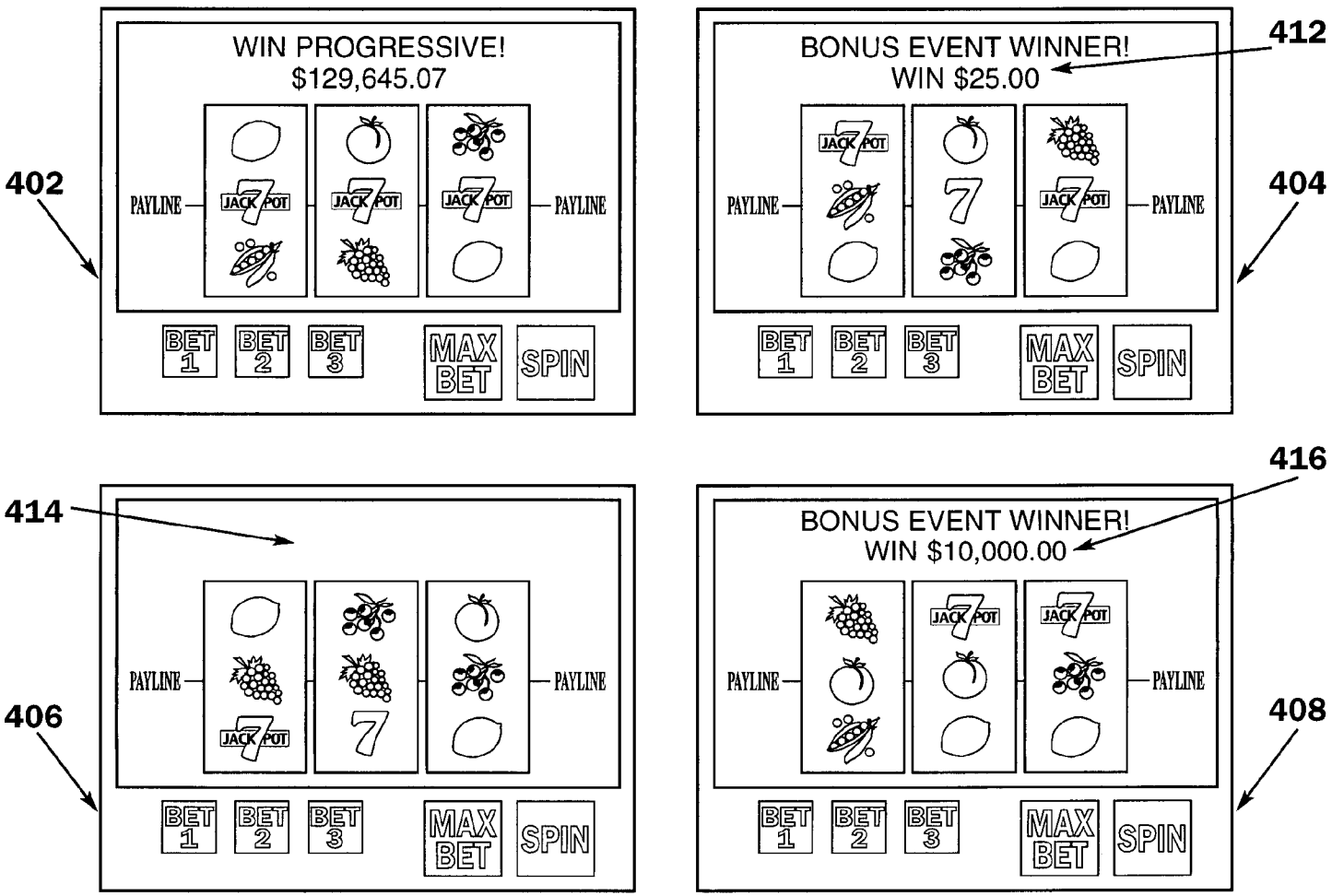
FIG. 7 is an image of four screen shots of four linked gaming machines.

FIG. 7 shows screen shots of four different linked machines 402, 404, 406 and 408. Absolute win amounts (as opposed to fractions of the progressive jackpot) are shown to be awarded on Screens 404 and 408 as $25.00 (412) and $10,000.00 (416), respectively. The space 414 remains blank on screen 406 where no random bonus was selected for that machine.

Figure 7A:
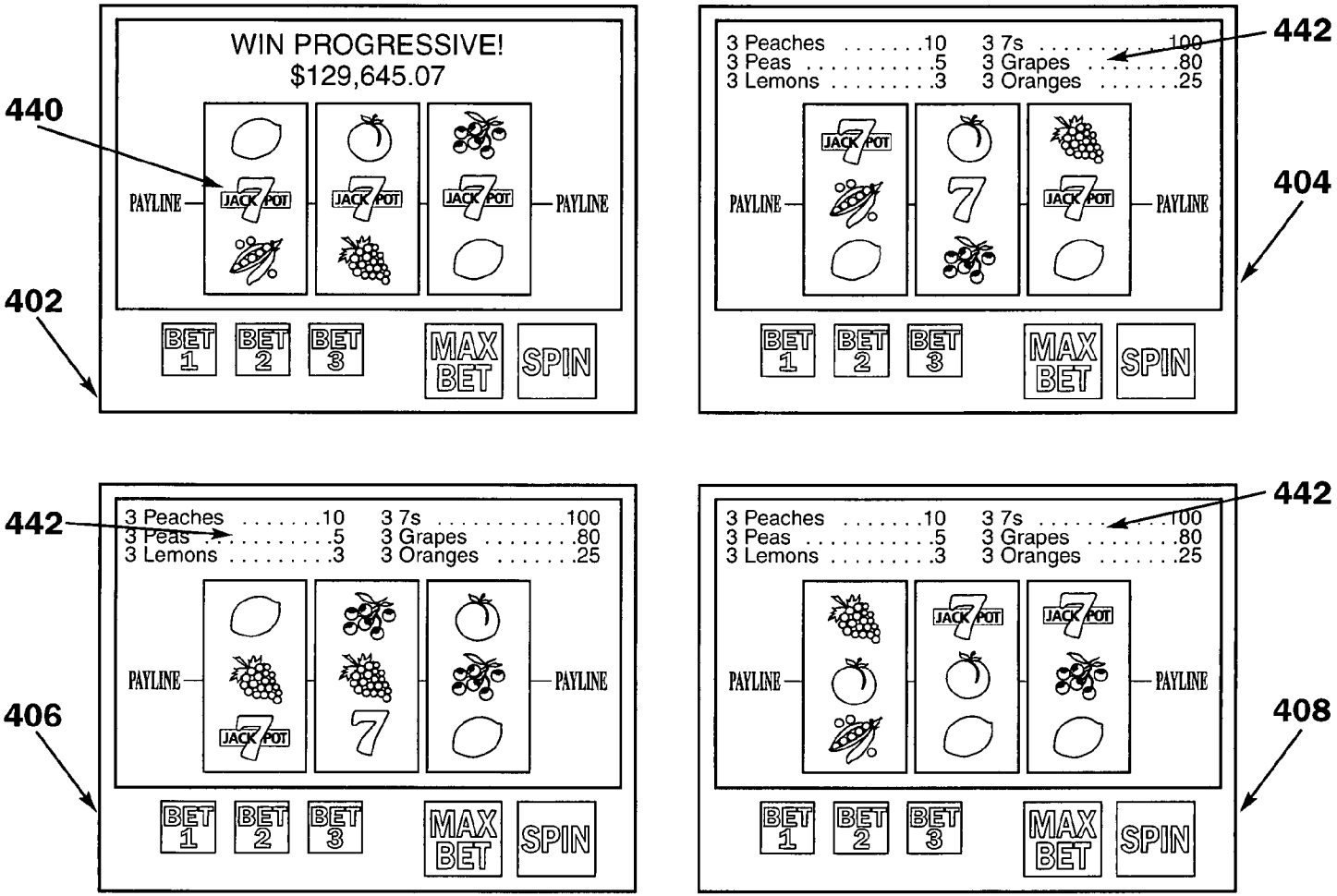
FIG. 7A is an image of four screen shots of four linked gaming machines.

FIG. 7A shows a first machine 402 with a jackpot payline 440, and the three separate machines 404, 406 and 408 showing standard paytables 442.

Figure 7B:
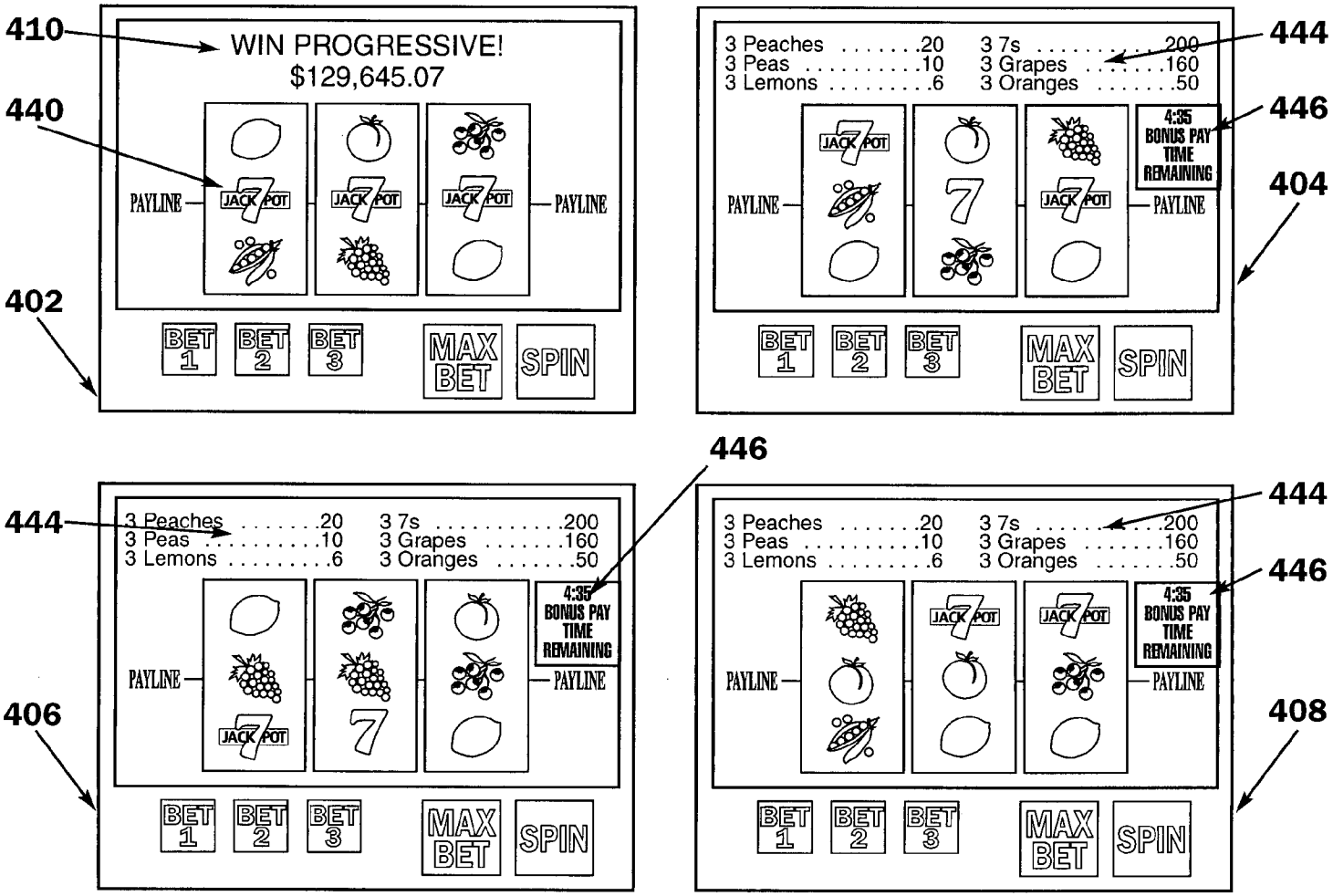
FIG. 7B is an image of four screen shots of four linked gaming machines.

FIG. 7B shows that the pay tables on screen 404, 406 and 408 (444) have been uniformly altered (increased) upon the indication of the jackpot line win 440 and the progressive win notice 410 on the first machine 402. The pay tables may be differentially changed among machines also, with random selection of machines 404, 406 and 408 being made to receive different pay tables as the adjunct bonus event. A countdown clock 446 shows the amount of time remaining for the increased paytables.

Figure 8:
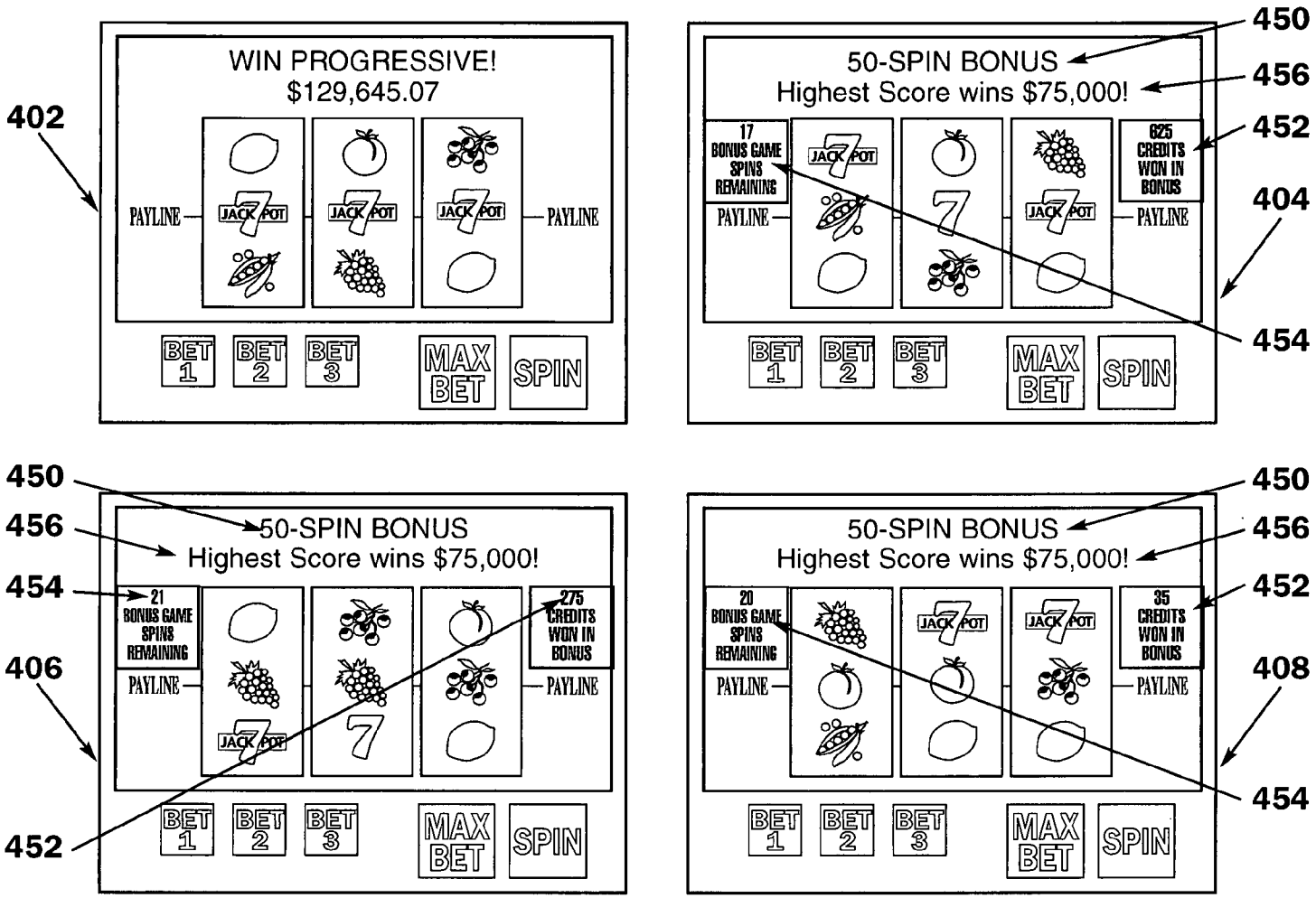
FIG. 8 is an image of four screen shots of four linked gaming machines.

FIG. 8 shows uniform spin bonuses 450 awarded to random players on occurrence of the progressive win on machine 402. An indicator of the number of remaining spins (454) and a running tally of the total credits won per machine during the bonus (452) also appear on the eligible linked machines 404, 406 and 408. The highest total achieved during the bonus spin event may win an absolute amount ($75,000.00, for example) as shown in screen announcement 456.

Figure 9:
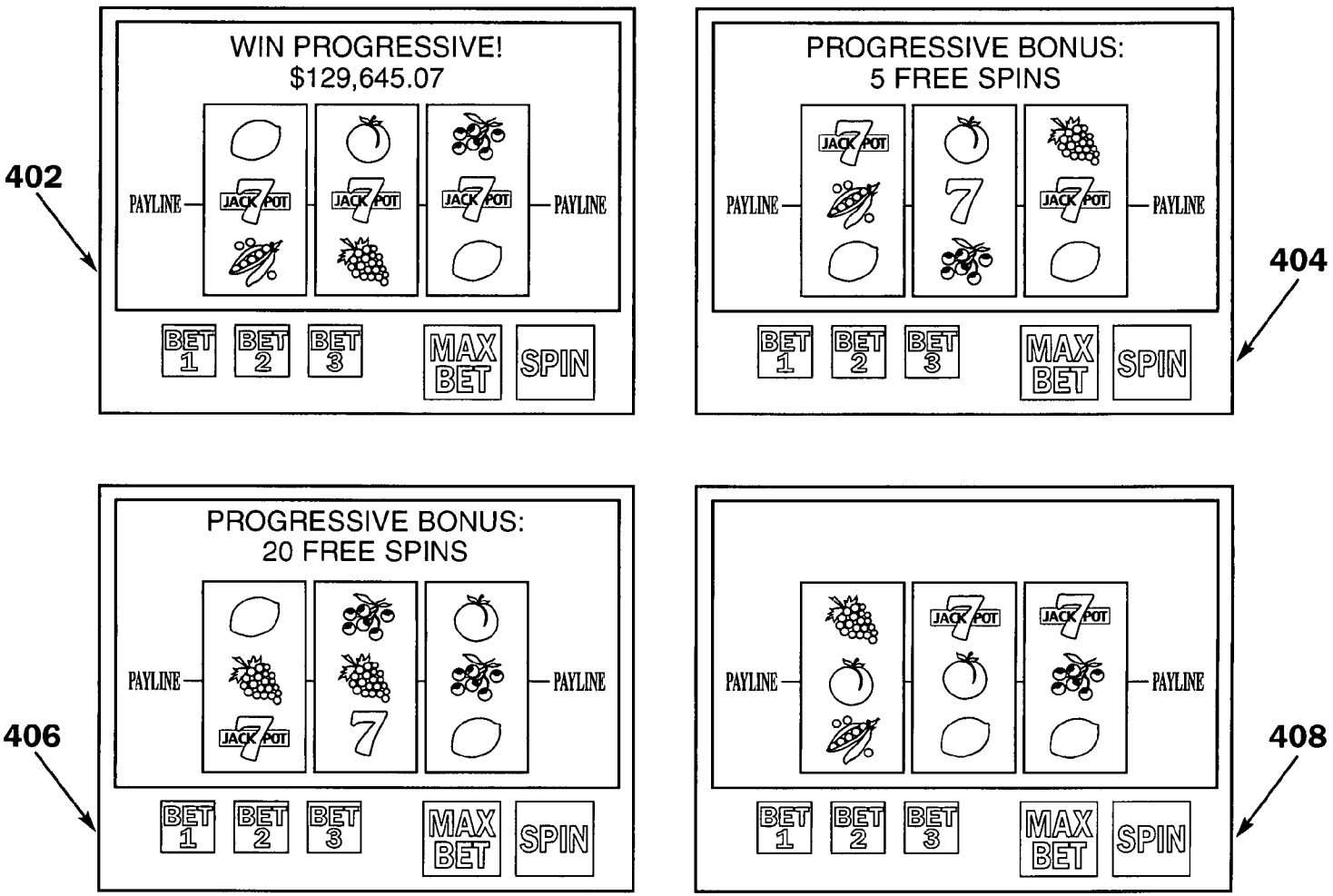
FIG. 9 is an image of four screen shots of four linked gaming machines.

FIG. 9 shows the random award of different numbers of free spins on machines 404, 406 and 408, with machine 408 receiving no free spins when the jackpot is won on machine 402.

Figure 10:
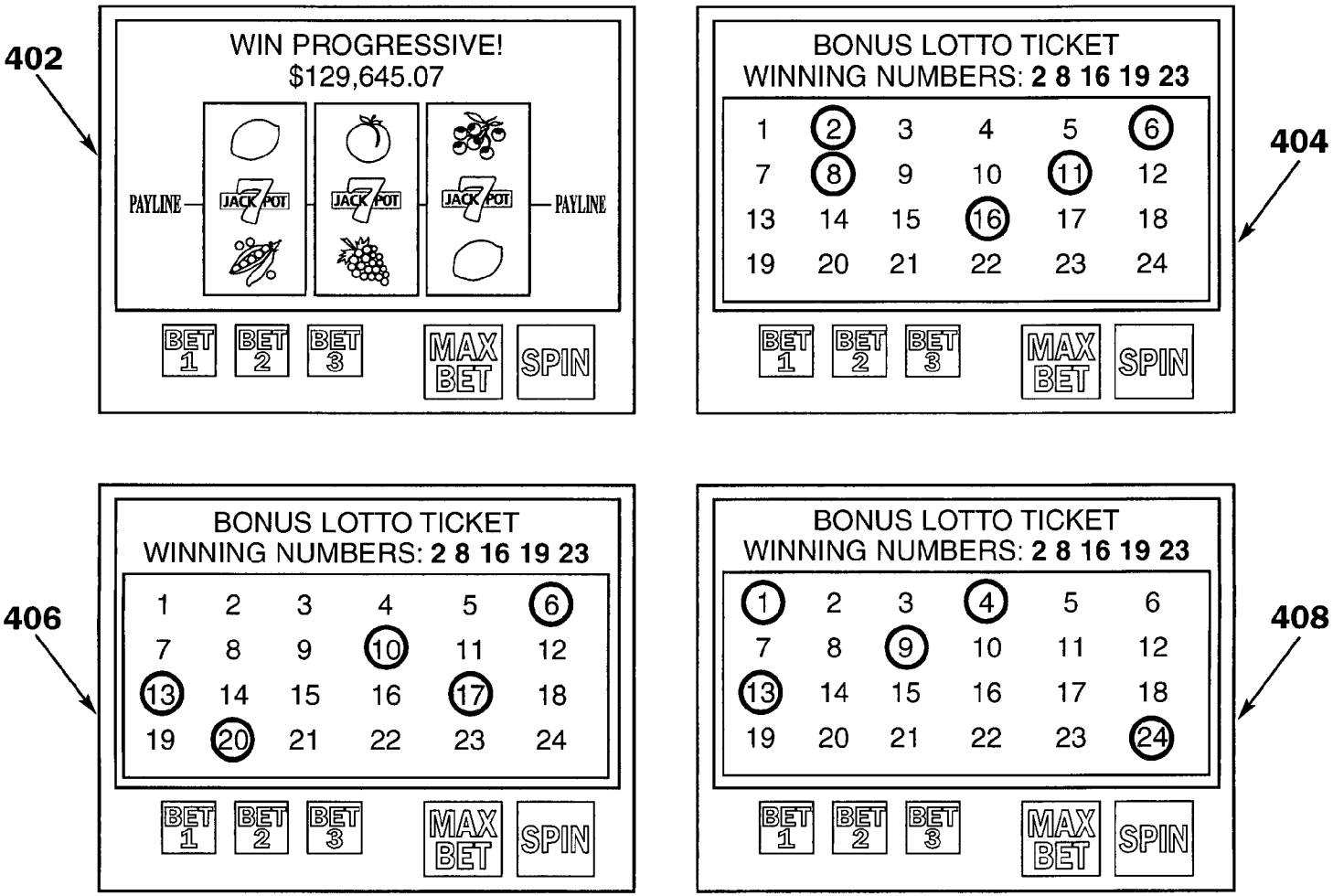
FIG. 10 is an image of four screen shots of four linked gaming machines where a keno-type award is provided.

FIG. 10 shows machines 404, 406 and 408 awarding lotto tickets (e.g., lottery tickets, keno tickets, Lotto™ tickets, or other possible winning tickets, including those on sports events, pari-mutuel pools, horse races, dog races, and the like) to random players or all players when a jackpot has been won on machine 402. These tickets may be played through the respective machines, or may have to be validated for winning events at a cashier or sports book window, or their facility. If keno tickets, for example, the tickets may be automatically validated on the machine according to a present or past game, or the machine may print a ticket or hold an electronic ticket (assigned to the specific player's account) for a later event. The player can be notified if the ticket later becomes a winner by tracking the player's card. The winning numbers of the player's awarded numbers may be displayed in typical keno-type fashion, one-at-a-time, or the entire number display may be shown on the screen in a single video event.

Figure 11:
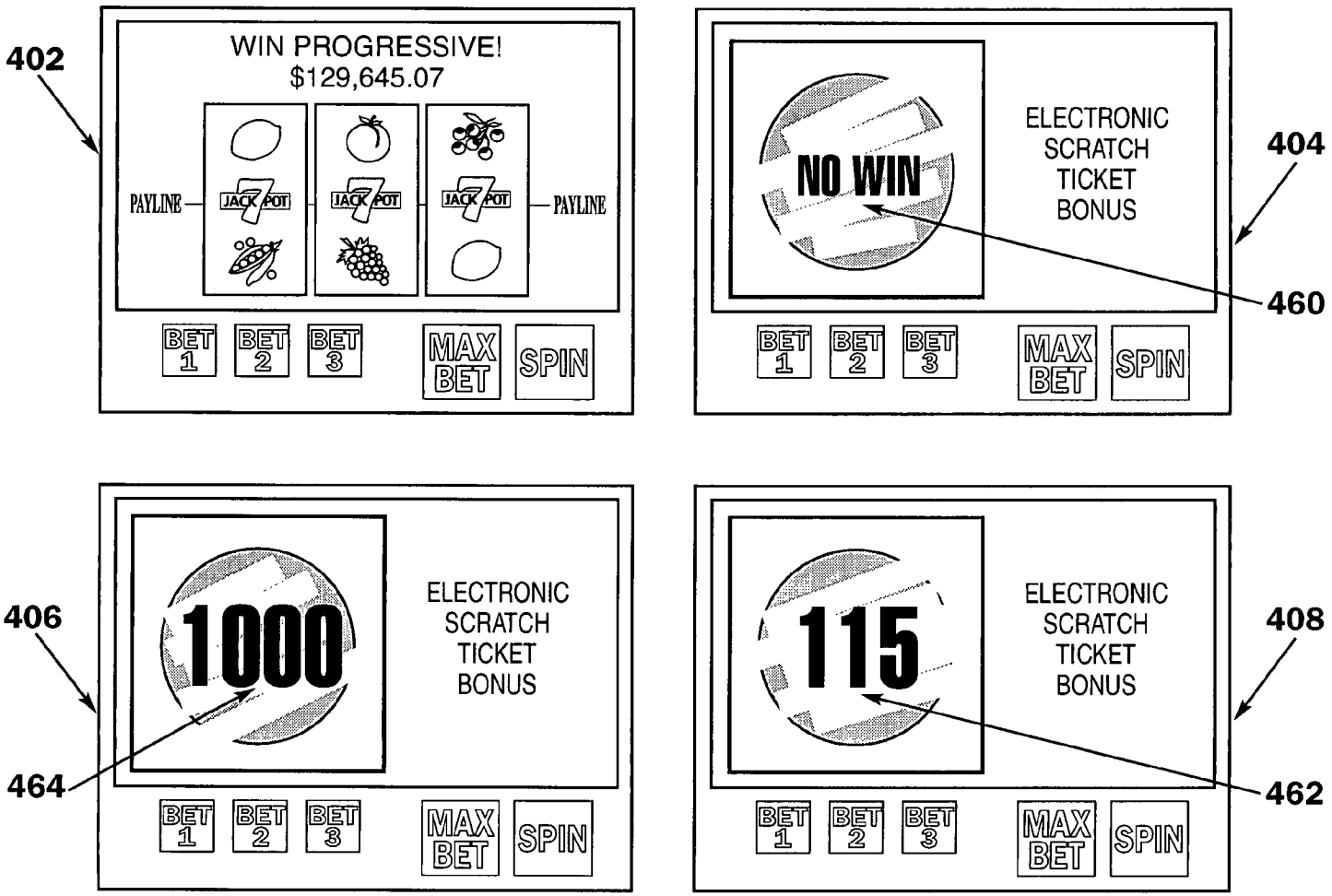
FIG. 11 is an image of four screen shots of four linked gaming machines where a ticket-type award is provided.

FIG. 11 shows the random award of scratch tickets, either electronically of physically by distribution from the machines 402, 404, 406 and 408. The amount of winnings for the electronic scratch tickets awarded may be displayed immediately or with some dramatic hesitation as shown in award notices 460, 462 and 464. It is also possible that the random awards may also include the potential for the jackpot winning machine 402 to receive bonus awards, rather than only non-jackpot winning qualifying players. Basis for qualifying, as noted previously, can be on any selected basis, including, but not limited to continuing play on the linked machine, continuing maximum play on the linked machine, a win at the same time (preceding of following the jackpot win) as the jackpot win, length of time on the machine, a rated player with card in the machine, and the like.

Figure 12:
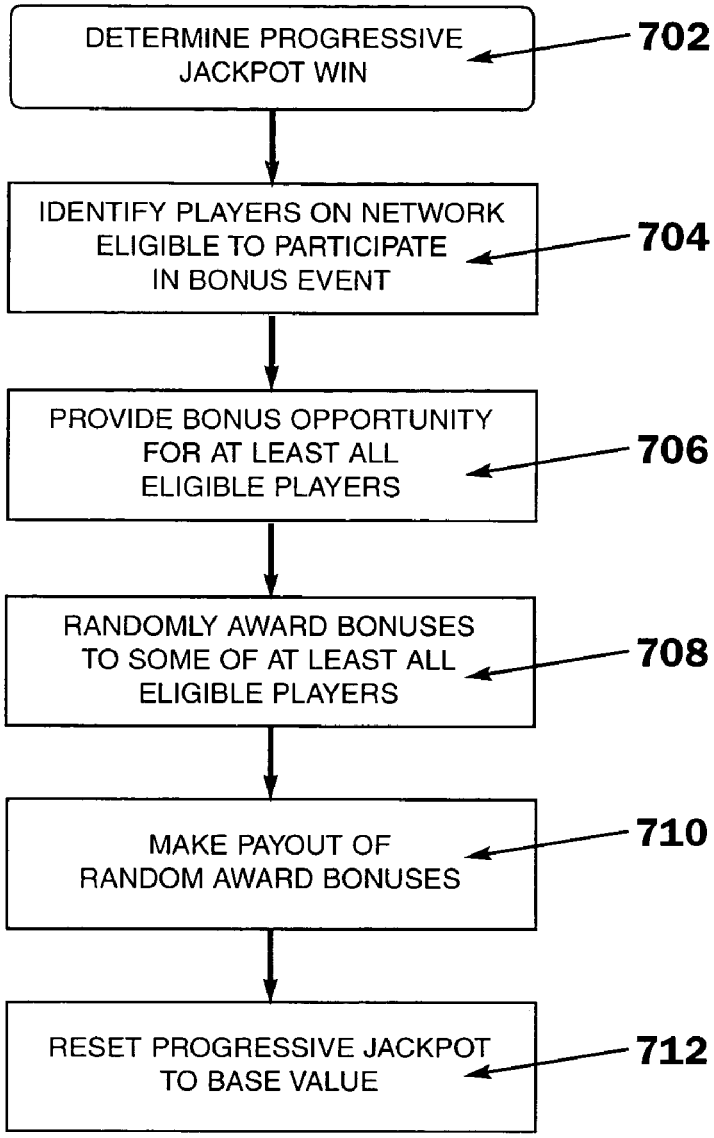
FIG. 12 is a flow diagram of one method of play according to the invention.

FIG. 12 is a flow chart that depicts one non-limiting method of play according to the present invention. Box 702 indicates that the system determines that a progressive jackpot win (or fixed jackpot win, such as a fixed $25,000.00) has been won in the linked machines. Box 702 indicates that the system determines the players on the linked machines (network) that are eligible to participate in the bonus event. The various types of qualifying methods or tests have been described above. Box 706 indicates that the system then makes the bonus opportunity, theoretically possible for every qualified player. The bonus is only theoretically possible because the selection of awards is random and there may be a fixed number of awards available, and that fixed number may be less than the total of all players linked on the system or qualified for the bonus. The number of awards available may be a fixed number, a number that is a whole integer based on a percentage of the total number of linked and/or qualified players, a number based on the total time (machine hours) played since the last jackpot was won, or any other convenient basis. For example, if the number based on the percentage of players playing is used, the format could be 40% of qualified players on the system when the jackpot is won. If there were 867 qualified players on the system, then 0.40×867 or 346.8 (rounded up or down to 347 or 346) players would receive bonus awards. The percentage may be anywhere from 1 to 100%, and the percentage could float along with the number of qualified players. Awards could also be randomly assigned to players so that a large bonus award was or was not given when there were few qualified players. For example, if there were 100 fixed awards, and there were only 70 players qualified on the system, then a maximum of 70 awards might be given out (randomly of course), but with the bonus awards excluding a major award (such as the $75,000.00 bonus). This can be done by an algorithm that determines a percentage of the fixed available prizes may be awarded based on system utilization. For example:

<100 Prizes available>

<?System Utilization>

<Greater than 120 qualified Players><All 100 prizes awarded randomly>

<Fewer than 120 but≧than 100 Qualified Players><80 prizes awarded.

<Fewer than 100 but≧80 Qualified players><60 prizes awarded>

<Fewer than 80 but≧60 Qualified players><40 prizes awarded>

<Fewer than 60 but≧40 Qualified players><20 prizes awarded>

<Select less than all prizes randomly from lowest value 90 awards>

Box 708 indicates that bonus awards are provided randomly to at least some of all the qualified players. Random selection may be by randomly selecting players, randomly selecting from among available bonus awards, and then providing the randomly selected awards to the randomly selected players. Random selection may also be accomplished by first randomly selecting the awards and then randomly selecting the player to whom the award is to be randomly given. The value of the awards may also be random within fixed groups based on value that the casino and/or system has predetermined is a strategic and marketable amount.

Box 710 indicates that the system then actually credits the random bonus award to the randomly selected qualified players, for example, according to the various techniques described above, including but not limited to direct account crediting, ticket awards, electronic ticket awards and the like.

Box 712 indicates that the system then resets the progressive jackpot to a base amount, assuming that it is a progressive jackpot game in the linked system. An advantage to the present system is that if a fixed award event is used (e.g., a jackpot of $100,000.00) and the amount of the potential randomly allocated bonus event is progressive, the system may well attract more players than if the system has only a progressive primary game. The jackpot may be progressive or not, and the randomly assigned bonus may be based upon a separately funded jackpot bonus event. For example, the jackpot may be a fixed amount and the bonus event total award may be based on a separately funded progressive pool from linked machines.

Although specific procedures, materials, and components have been described in the specification, the descriptions are intended to be exemplary of a generic practice of the invention and are not intended to be use as narrowing limits for practice of the invention.

What is claimed is:

1. A method of playing a gaming system played by a plurality of players where a jackpot is awarded, the method comprising:

accepting wagers made by players playing an underlying wagering game via a plurality of wager input devices;

when an outcome occurs in the underlying wagering game that identifies that a jackpot is to be awarded to at least one of said players, entering a special bonus event for all of said players presently playing the underlying wagering game, the special bonus event providing a chance to be awarded bonuses;

randomly selecting bonuses to be awarded in the special bonus event via a processor; and randomly selecting more than one but less than all of said players to be awarded the randomly selected bonuses and excluding at least one player from being awarded any bonus via the processor, said randomly selected bonuses being in addition to any awards some of said players may win during continued play of the underlying wagering game.

2. The method of claim 1 wherein the underlying game is a casino table game.

3. The method of claim 1 wherein the underlying game is played on a slot-type wagering apparatus.

4. The method of claim 3 wherein the slot-type wagering apparatus is a networked wagering apparatus.

5. The method of claim 4 wherein the jackpot is a progressive jackpot.

6. The method of claim 3 wherein the bonuses do not decrement the jackpot.

7. The method of claim 4 wherein the bonuses do not decrement the jackpot.

8. The method of claim 5 wherein the bonuses do not decrement the jackpot.

9. The method of claim 1 further comprising excluding the player who received the jackpot from being randomly awarded a bonus from the special bonus events.

10. The method of claim 5 further comprising excluding the player who received the progressive jackpot from being randomly awarded the bonus from the special bonus event.

11. The method of claim 4 wherein the bonus is selected from the group consisting of immediate random bonus awards, immediate play bonus awards, mini-jackpot awards, free play awards, electronic game tickets, physical game tickets, and combinations thereof.

12. The method of claim 8 wherein the bonus is selected from the group consisting of immediate random bonus awards, immediate play bonus awards, mini-jackpot awards, free play awards, electronic game tickets, physical game tickets, and combinations thereof.

13. The method of claim 5 wherein the bonus is selected from the group consisting of immediate random bonus awards, immediate play bonus awards, mini-jackpot awards, free play awards, electronic game tickets, physical game tickets, and combinations thereof.

14. The method of claim 7 wherein the bonus is selected from the group consisting of immediate random bonus awards, immediate play bonus awards, mini-jackpot awards, free play awards, electronic game tickets, physical game tickets, and combinations thereof.

15. The method of claim 11 wherein the bonus is selected from the group consisting of immediate random bonus awards, immediate play bonus awards, mini-jackpot awards, free play awards, electronic game tickets, physical game tickets, and combinations thereof.

16. A method of playing a gaming system played by a plurality of players where a jackpot is awarded, the method comprising:

permitting players to play underlying wagering games in which wagers are made by the players via wager input devices;

when an outcome occurs in one of the underlying wagering games that identifies that a jackpot is to be awarded to at least one player, entering a special bonus event for all players presently playing the underlying wagering games, the special bonus event providing a chance to be awarded bonuses;

randomly selected bonuses to be awarded via a processor; and randomly selecting more than one but less than all players to be awarded the randomly selected bonuses in addition to any awards the some of the players may win during continued play of the underlying wagering games but excluding at least one player from winning any award via the processor, wherein the randomly selected bonuses are based upon a progressive bonus jackpot.

17. The method of claim 16, wherein the underlying game is a casino table game.

18. The method of claim 16, wherein the underlying game is played on a slot-type wagering apparatus.

19. The method of claim 18, wherein the slot-type wagering apparatus is a networked wagering apparatus.

20. The method of claim 16, wherein the bonuses do not decrement the jackpot.

21. The method of claim 16 further comprising excluding the player who is awarded the jackpot from being randomly awarded a bonus from the special bonus events.

22. The method of claim 16 wherein the randomly selected bonuses are selected from the group consisting of immediate random bonus awards, immediate play bonus awards, mini-jackpot awards, free play awards, electronic game tickets, physical game tickets, and combinations thereof.

* * * * *